United States Patent [19]

Bond et al.

[11] Patent Number: 4,516,132

[45] Date of Patent: May 7, 1985

[54] ANTENNA WITH A REFLECTOR OF OPEN CONSTRUCTION

[75] Inventors: Kevin Bond, Harlow; Brian W. Watson, Sawbridgeworth, both of England

[73] Assignee: Cossar Electronics Limited, Harlow, England

[21] Appl. No.: 505,372

[22] Filed: Jun. 16, 1983

[30] Foreign Application Priority Data

Feb. 24, 1983 [GB] United Kingdom ..... 8305196

[51] Int. Cl.[3] ..... H01Q 9/28; H01Q 15/14

[52] U.S. Cl. ..... 343/815; 343/912

[58] Field of Search ..... 343/815, 834, 838, 817, 343/818, 912

[56] References Cited

U.S. PATENT DOCUMENTS 3,836,977 9/1974 Wheeler ..... 343/815

4,114,163 9/1978 Borowick ..... 343/815

FOREIGN PATENT DOCUMENTS 704953 5/1931 France ..... 343/818

*Primary Examiner*—Eli Lieberman

*Attorney, Agent, or Firm*—Robert F. O'Connell

[57] ABSTRACT

The antenna 10 comprises a line of radiating columns 12 extending transversely to the line and a plurality of conducting rods 14 interspersed among the columns 12. The conducting rods 14 are aligned along two lines 22*a*, 22*b* to form two reflecting arrays spaced one behind the other with respect to the look direction 11 of the antenna 10. The spacing is one quarter wavelength at the operating frequency.

10 Claims, 3 Drawing Figures

ANTENNA WITH A REFLECTOR OF OPEN CONSTRUCTION

The present invention relates to antennae which comprise a line of radiating columns extending transversely to the line and a plurality of conducting rods interspersed among and parallel with the columns.

Antennae which are required to transmit or receive signals in a particular direction or range of directions comprise a reflecting structure arranged to reduce substantially back radiation, in the direction opposite to the desired look direction. Metal sheets or meshes are often used to form the reflectors. Such a reflector for a large antenna presents a large surface area on which the wind may bear and, consequently, the supporting structure of the antenna must be of extremely sturdy construction in order to withstand the wind forces.

It is desirable to provide an open reflector, that is a reflector which has a reduced surface area but which retains reasonable reflective properties. One known solution to this problem in the case of an antenna formed of radiating columns is to intersperse the columns with conducting rods. The front-to-back ratio, that is the ratio between the power radiated in the look direction and the power radiated in the back direction, depends on the spacing and diameter of the rods. To make the ratio suitably high, the rods need to be fairly closely spaced, as well as thick enough, and it is difficult to achieve an adequate front-to-back ratio without making the wind resistance unacceptably high, because of the close spacing.

In an attempt to overcome this problem, GB No. 1393081 discloses an antenna comprising a line of parallel, conducting columns which carry radiating dipoles. The direction of polarization of the dipoles is parallel to the columns, that is, the electric vector of the emitted radiation and the columns are coplanar. The conducting columns themselves act as reflectors. Interspersed among the conducting columns are colinear arrays of tuned reflecting elements. The tuned reflectors are metallic rods of lengths such as to resonate at the design frequency of the antenna. The antenna reflector is therefore tuned and the antenna has a narrow bandwidth.

The object of the present invention is to improve the front-to-back ratio without a concomitant reduction in the bandwidth of the antenna.

The present invention is characterised in that the conducting rods lie along two spaced lines to form a first reflecting array and a second reflecting array spaced behind the first array relative to the look direction of the antenna. The invention thus provides a broadband antenna which has an open reflector.

Figure 1:
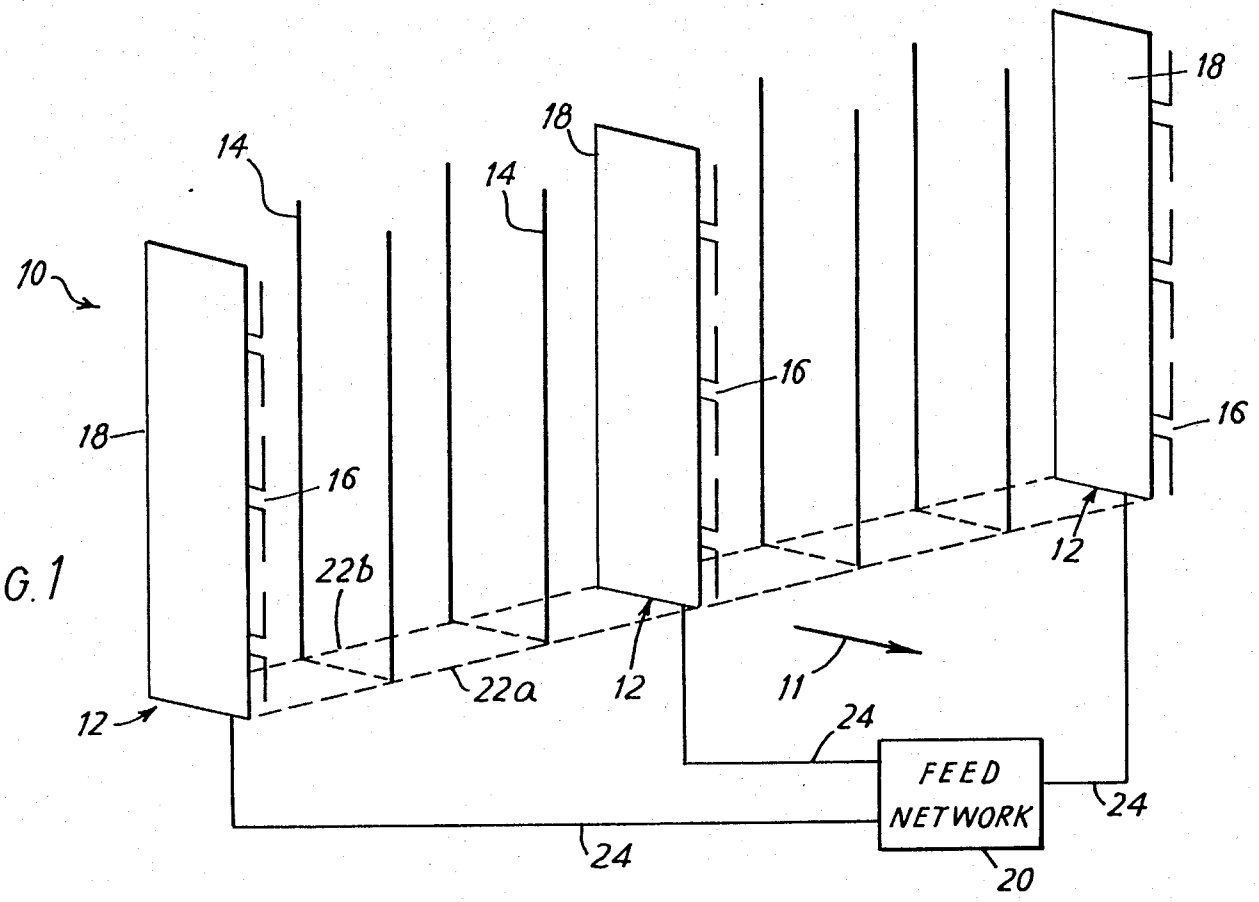
Figure 3:
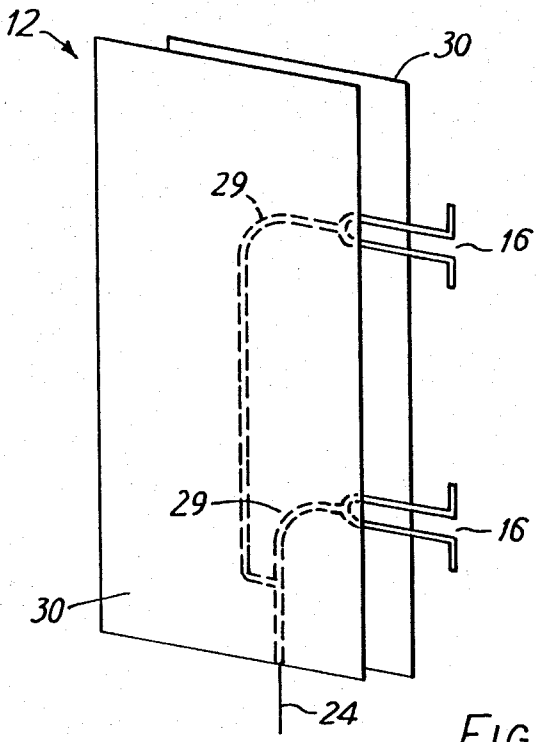
Figure 2:
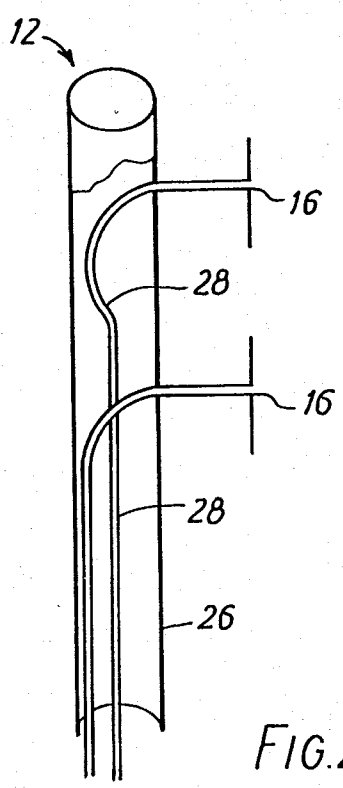

An embodiment of the invention will be described, by way of example, with reference to the accompanying drawings in which:

FIG. 1 is a diagrammatic, perspective view of a portion of an antenna embodying the invention and FIGS. 2 and 3 are a diagrammatic section and a diagrammatic perspective view respectively of alternative active elements of the antenna of FIG. 1.

Referring to FIG. 1, a portion of an antenna 10, which has a look direction 11, comprises illustratively three radiating columns 12 (more will typically be used) among which are interspersed conducting rods 14. The radiating columns 12, which will be discussed in more detail later, in relation to FIGS. 2 and 3, comprise dipole radiators supported by supporting columns 18. The columns 12 are aligned and extend transversely to their line. The dipole radiators 16 are polarized substantially parallel to the columns 12, and are connected to the feed network 20 of the antenna 10 by connectors 24 which pass through the columns 20.

Four conducting rods 14 are positioned between adjacent columns 12 by a supporting structure not shown in FIG. 1. The conducting rods 14 are aligned along two lines *22a, 22b* spaced one behind the other relative to the look direction 11 of the antenna 10. The two lines of rods 14 each form a reflecting array. The reflective properties of an array of conducting rods depend on various parameters of the array design, for instance the rod diameter and the spacing between adjacent rods, and on parameters of use, for instance the frequency and angle of incidence of the incident radiation. The rear line *22b* of rods enhances the reflective properties of the front line *22a*. The front-to-back ratio is maximised when the spacing of the lines *22a, 22b* is substantially one quarter of the operating wavelength of the antenna. The number and spacing of the conducting rods 14 may be varied according to the particular requirements of any intended application. The rods 14 of the two reflecting arrays may be in or out of register; they are shown in register.

FIG. 2 illustrates one alternative design of radiating column. The column 12 comprises a hollow metal tube 26 from which project radiating dipoles 16. Coaxial lines 28 inside the tube 26 connect the dipoles 16 to the feed network of the antenna. The tube 26 screens the coaxial cables from radiation transmitted or received by the antenna. The tubes 26 also act as reflectors.

FIG. 3 shows the preferred form of radiating column 12 which has a stripline feed arrangement 29 connecting the dipoles 16 to the feed network. The stripline conductors are shown purely schematically. They are arranged in accordance with well known principles to divide the power from the corresponding feed conductor 24 between the dipole elements 16, which, in a practical structure, will be more than the two shown in FIG. 3 by way of illustration. The stripline is sandwiched between two insulating substrates, not shown, which are sandwiched in turn between two conducting ground planes 30 which also act as reflectors supplementing the rods 14.

It will be seen that the number and spacing of radiating columns, the number of dipoles on each column, and the number and spacing of conducting rods which comprise the antenna are all quantities which can be varied within the scope of the invention. Other forms of radiating columns may be used. The antenna provided by the invention is broadband, because the reflector rods are not resonant elements, and has a wind resistance which is much lower than that of an antenna with a sheet reflector and lower than a reflector with one line of rods achieving a comparable front-to-back ratio.

We claim:

1. An antenna comprising a plurality of radiating columns and a plurality of conducting rods, said radiating columns being disposed in a line and extending transversely to said line, a first set of said conducting rods being parallel to said radiating columns and disposed in a line to form a first reflecting array, and a second set of said conducting rods being parallel to said radiating columns and disposed in a line to form a second reflecting array, said second array being spaced behind said first array relative to the look direction of the antenna.

2. An antenna according to claim 1, in which the spacing of said first and second arrays is substantially one quarter of the operating wavelength of the antenna.

3. An antenna according to claim 1, in which said radiating columns comprise a plurality of dipole radiators supported by a supporting column.

4. An antenna according to claim 3, in which said dipole radiators are polarized transverse to the line of said radiating columns.

5. An antenna according to claim 3, in which said supporting column is a cylinder of electrically conducting material and the antenna further comprises means for conveying signals to and from said dipole radiators, said signal conveying means being housed in said cylinder.

6. An antenna according to claim 5, in which said signal conveying means is a coaxial line.

7. An antenna according to claim 3, in which said supporting column comprises a stripline connector for conveying signals to and from said dipole radiators, a substrate, and two electrically grounded, conducting planes, said stripline being mounted on said substrate which is sandwiched between said two conducting planes.

8. An antenna according to claim 4, in which said supporting column is a cylinder of electrically conducting material, and the antenna further comprises means for conveying signals to and from said dipole radiators, said signal conveying means being housed in said cylinder.

9. An antenna according to claim 8, in which said signal conveying means is a coaxial line.

10. An antenna according to claim 4, in which said supporting column comprises a stripline connector for conveying signals to and from said dipole radiators, a substrate, and two electrically grounded, conducting planes, said stripline being mounted on said substrate which is sandwiched between said two conducting planes.

* * * * *